US005228315A

United States Patent [19]

Nagasaka et al.

[11] Patent Number: 5,228,315

[45] Date of Patent: Jul. 20, 1993

[54] CONDENSER HAVING A RECEIVER TANK FORMED INTEGRALLY THEREWITH

[75] Inventors: Yoshikiyo Nagasaka, Konan; Takehide Matsumoto, Higashi, both of Japan

[73] Assignee: Zexel Corporation, Tokyo, Japan

[21] Appl. No.: 811,033

[22] Filed: Dec. 20, 1991

[30] Foreign Application Priority Data

Dec. 28, 1990 [JP] Japan ..... 2-416243

[51] Int. Cl.[5] ..... F25B 39/04

[52] U.S. Cl. ..... 62/509; 165/110

[58] Field of Search ..... 62/509, 515; 165/110

[56] References Cited

U.S. PATENT DOCUMENTS 4,825,941 5/1989 Hoshino et al. ..... 165/110
4,972,683 11/1990 Beatenbough ..... 165/110
5,088,294 2/1992 Ando ..... 62/509
5,141,048 8/1992 Sausner ..... 165/110

FOREIGN PATENT DOCUMENTS 2-13954 1/1990 Japan .
2-103667 8/1990 Japan .
2-267478 11/1990 Japan .
3-31266 3/1991 Japan .

*Primary Examiner*—Ronald C. Capossela
*Attorney, Agent, or Firm*—Wenderoth, Lind & Ponack

[57] ABSTRACT

A condenser of the type having a receiver tank formed integrally with the condenser has each of two opposed header tanks composed of a tube-receiving plate and a tank plate. The tank plate of one of the header tanks is formed of an extruded section member having a hollow portion forming a receiver tank and the extruded section member further has auxiliary passages. The tube-receiving plates of the header tanks are structurally independent so that formation of tube-receiving holes and application of cladding material can be performed for each tube-receiving plate, and a condenser having a plurality of flow paths can be constructed. In addition, if heat transfer between the hollow portion and the one header tank has a negative effect on the operation of the condenser, a heat insulating space is formed between the hollow portion and the one header tank for controlling heat transfer therebetween.

16 Claims, 17 Drawing Sheets

CONDENSER HAVING A RECEIVER TANK FORMED INTEGRALLY THEREWITH

BACKGROUND OF THE INVENTION

1. Field of the Invention

The present invention relates to a condenser of the type having a receiver tank formed integrally with the condenser to constitute a portion of a refrigeration cycle.

2. Description of the Prior Art

A condenser formed integrally with a receiver tank is known from Japanese Laid-open Patent Publication No. 213954, for example. The known condenser includes an extruded section member constituting, as an integral unit, a body of the receiver tank and a header tank of the refrigerant outlet side of the condenser. A refrigerant flowing into a header tank of the refrigerant inlet side of the condenser is fed through tubes to the header tank of the refrigerant outlet side in which the refrigerant is guided upwardly and then takes a U-turn at an upper part of the header tank. Then the refrigerant is guided to fall down toward a lower portion of the body of the receiver tank.

With the receiver tank thus constructed, since the header tank of the refrigerant outlet side of the condenser and the body of the receiver tank are formed by a single member, it is difficult to form by punching tube-receiving holes used for firm connection of one end of the tubes with the header tank. Another problem is the difficulty in applying a brazing material needed for brazing between the tubes and the header tank.

Furthermore, the conventional condenser has a structure in which the refrigerant takes only one path as it flows from the header tank of the refrigerant inlet side to the header tank of the refrigerant outlet side. Accordingly, it does not meet the desire that the refrigerant takes plural paths so as to improve the heat radiation effect.

In the above-mentioned condenser with integral receiver tank, the gaseous refrigerant is kept at an elevated temperature under an elevated pressure, and as it flows through the tubes it gives off heat to air flowing around fins in a direction perpendicular to the fins disposed between the tubes. The gaseous refrigerant is thus changed into a liquid refrigerant of a low temperature and a high pressure. In the case where the refrigerant takes a U-turn several times, the refrigerant contains a large amount of a hot and compressed gaseous component flowing through a flow chamber disposed adjacent to the receiver tank. In this condition, the liquid refrigerant of a low temperature flowing through the receiver tank is very much affected by heat.

SUMMARY OF THE INVENTION

A condenser of the present invention comprises a pair of opposed header tanks, a plurality of tubes interconnecting the pair of header tanks, and a plurality of fins each disposed between two adjacent ones of the tubes. Each of the header tanks has a plurality of internal flow chambers arranged in the longitudinal direction of the header tank such that a refrigerant supplied to the condenser flows from a first one of the internal chambers to a final one of the internal flow chambers through the tubes while making plural U-turns. One of the pair of header tanks is composed of a first tube-receiving plate to which the tubes are firmly connected at one end thereof, and a first tank plate fitted with the first tube-receiving plate. The other of the pair of header tanks is composed of a second tube-receiving plate to which the tubes are firmly connected at an opposite end thereof, and a second tank plate fitted with the second tube-receiving plate, the second tank plate being integral with an extruded section member, the extruded section member including a hollow portion defining a gas-liquid separation chamber, and the gas-liquid separation chamber having an upper portion communicating with the final flow chamber. The extruded section member may further have a heat insulating space extending longitudinally along the hollow portion.

It is an object of the present invention to provide a condenser of the type having a receiver tank formed integrally with the condenser which makes it possible to form, by punching, tube-receiving holes in header tanks, and apply a cladding material to the header tanks, and which is adaptable to a condenser in which the refrigerant takes plural paths.

Another object of this invention is to provide a condenser with an integral receiver tank having structural features that enable thermal blocking of the receiver tank from hot refrigerant flowing through the header tank.

The above and other objects, features and advantages of the present invention will become manifest to those versed in the art upon making reference to the detailed description and the accompanying sheets of drawings in which preferred structural embodiments incorporating the principles of the present invention are shown by way of illustrative examples.

BRIEF DESCRIPTION OF THE DRAWINGS

FIG. 23(*b*) is an enlarged cross-sectional view taken along line J—J of FIG. 21;

FIG. 23(*c*) is an enlarged cross-sectional view taken along line K—K of FIG. 21;

FIG. 25(*b*) is a side view of the end cap;

FIG. 27(*b*) is an enlarged cross-sectional view of a portion of the extruded section member indicated by M in FIG. 24;

FIG. 28(*b*) is a view similar to FIG. 27(*b*), but showing a modified form of the portion M of the extruded section member;

FIG. 30(*b*) is an enlarged cross-sectional view of the extruded section member taken along line 0—0 of FIG. 29;

FIG. 32(*b*) is an enlarged cross-sectional view of a portion of the condenser indicated by Q in FIG. 31, showing a modified extruded section member;

FIG. 33(*b*) is a view similar to FIG. 32(*b*), but showing another modified extruded section member.

DETAILED DESCRIPTION

The present invention will be described below in greater detail with reference to certain preferred embodiments illustrated in the accompanying drawings.

Figure 1:
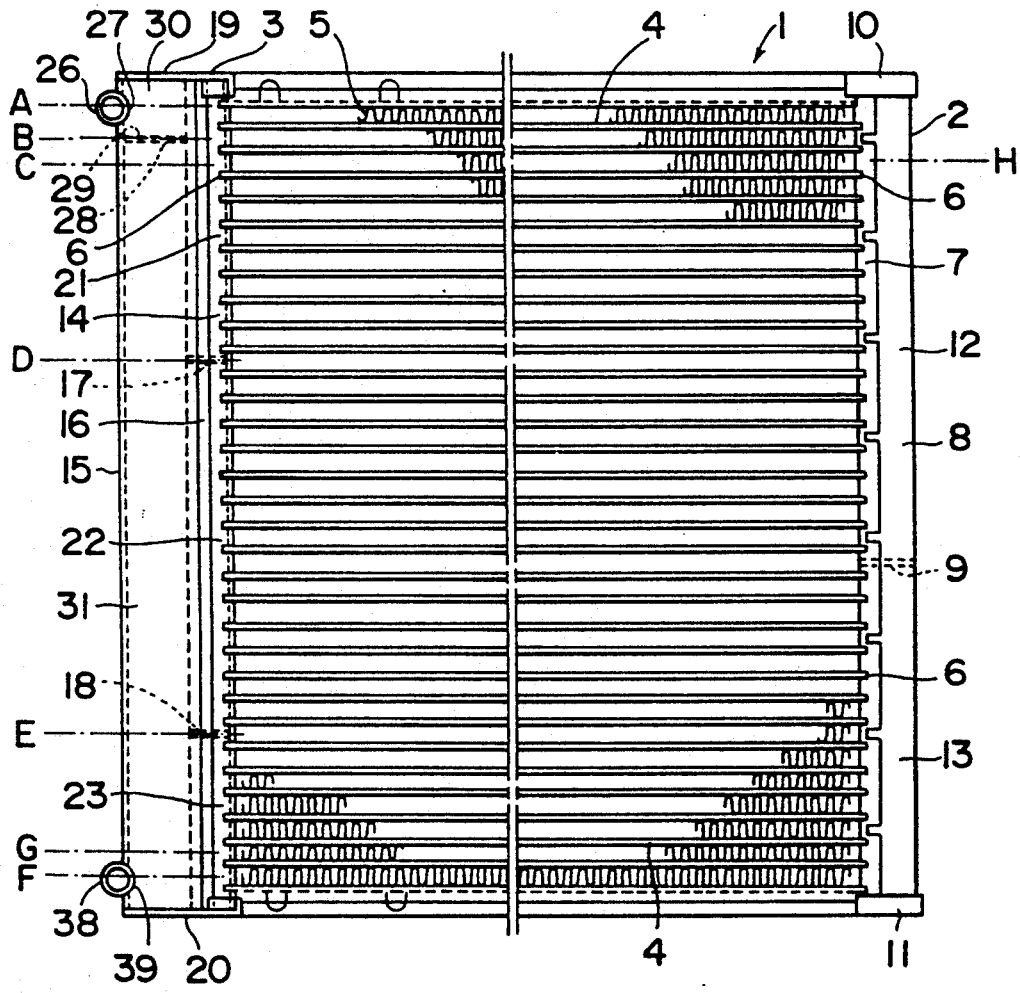
FIG. 1 is a front elevational view of a condenser having a receiver tank formed integrally therewith according to an embodiment of this invention.
Figure 2:
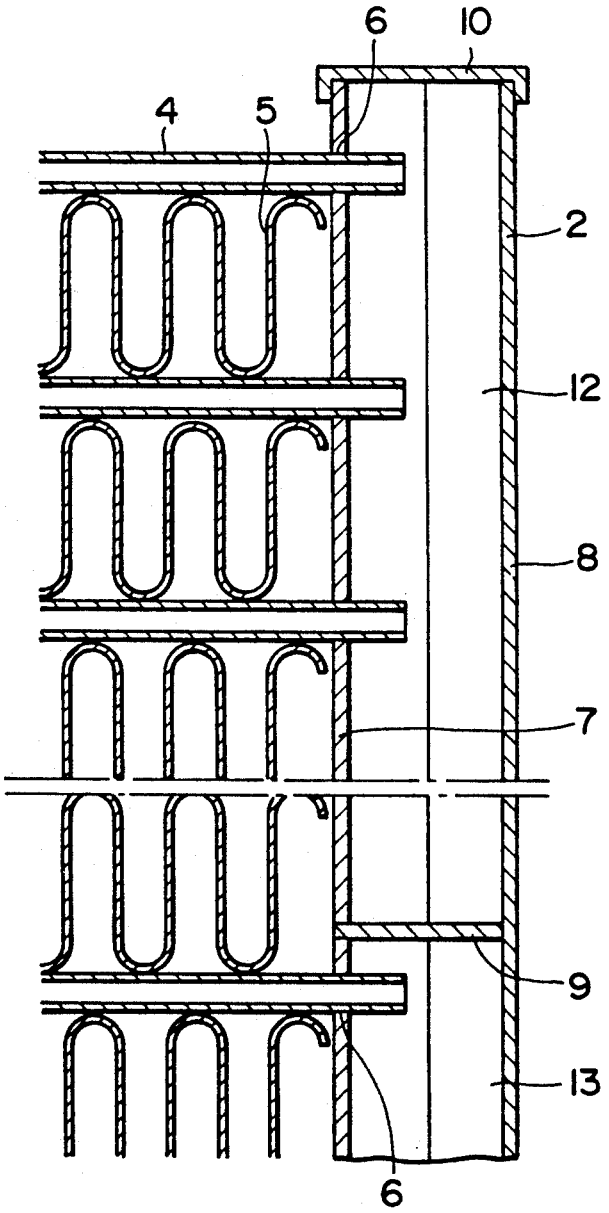
FIG. 2 is an enlarged cross-sectional view of a portion of the condenser including one of a pair of header tanks.
Figure 3:
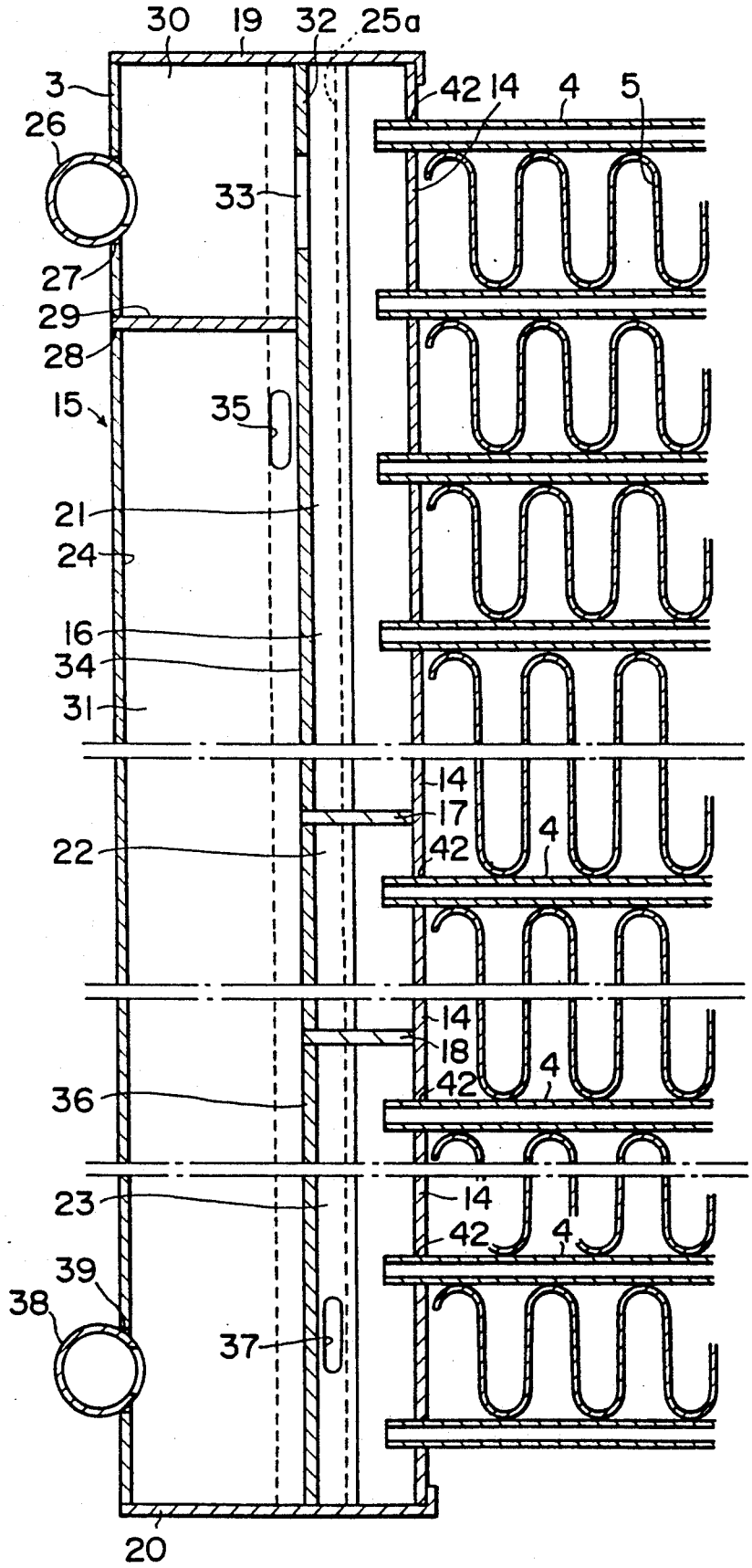
FIG. 3 is an enlarged cross-sectional view of a portion of the condenser including the other header tank.

FIGS. 1 through 3 shows a condenser having a receiver tank formed integrally therewith according to a first embodiment of this invention. The condenser 1 includes a pair of opposed header tanks 2 and 3, a plurality of parallel spaced tubes 4 interconnecting the two header tanks 2 and 3, and a plurality of fins 5 each disposed between two adjacent ones of the tubes 4.

Figure 4:
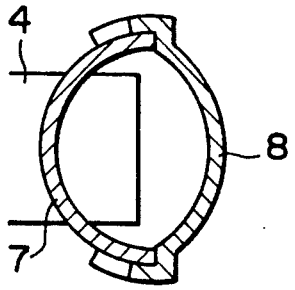
FIG. 4 is an enlarged cross-sectional view taken along line H—H of FIG. 1, showing the one header tank of the condenser.

The header tank 2, as also shown in FIG. 4, is composed of an arcuate tube-receiving plate 7 with a row of tube-receiving holes 6 along the length thereof, and an arcuate tank plate 8 joined with the tube-receiving plate 7 in face to face confrontation. A partition plate 9 is disposed between the tube-receiving plate 7 and the tank plate 8 so as to define upper and lower flow chambers 12 and 13 on opposite sides of the partition plate 9. Upper and lower ends of the header tank 2 are closed by upper and lower end caps 10 and 11, respectively.

The header tank 3, as also shown in FIGS. 5 through 10, is composed of an arcuate tube-receiving plate 14 with a row of tube-receiving holes 42 along the length thereof and an arcuate tank plate 16 formed integrally with an extruded section member 15 (described later) and joined with the tube-receiving plate 14 in face to face confrontation. Two vertically spaced partition plates 17 and 18 are disposed between the tube-receiving plate 14 and the tank plate 16, so as to define therebetween an upper flow chamber 21, an intermediate flow chamber 22 and a lower flow chamber 23. Upper and lower ends of the header tank 3 are closed by upper and lower end caps 19 and 20, respectively. The end caps 19 and 20 also close upper and lower ends of the extruded section member 15.

The extruded section member 15, as shown in FIGS. 5 through 10, includes a substantially cylindrical hollow, portion 24 and has a pair of laterally spaced communicating passages 25*a* and 25*b* provided outside the cylindrical hollow portion 24 along the length thereof. The tank plate 16 is disposed adjacent to the cylindrical hollow portion 24 and the communicating passages 25*a* and 25*b* in such a manner, that a part of a peripheral wall defining each of the communicating passages 25*a* and 25*b* and a part of a peripheral wall of the cylindrical hollow portion 24 also form a part of the tank plate 16.

Figure 5:
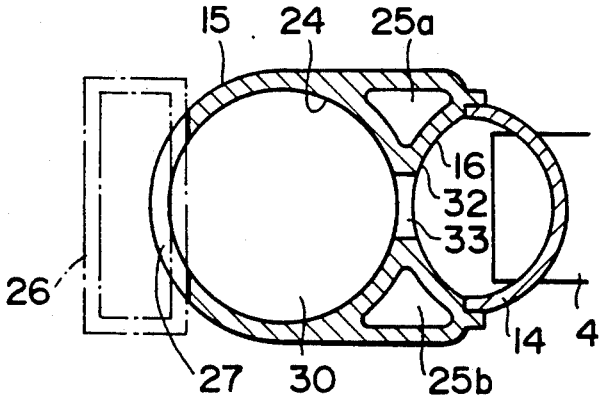
FIG. 5 is an enlarged cross-sectional view taken along line A—A of FIG. 1.
Figure 6:
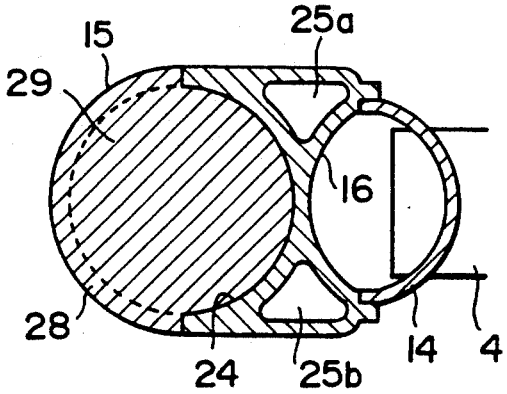
FIG. 6 is an enlarged cross-sectional view taken along line B—B of FIG. 1.

The cylindrical hollow portion 24 has a connecting hole 27 near its upper end. The connecting hole 27 communicates with a refrigerant inlet pipe 26, as also shown in FIG. 5. The cylindrical hollow portion 24 also has a transverse slit 28 provided below the connecting hole 27. As also shown in FIG. 6, a partition wall 29 is firmly fitted in the slit 28 so as to separate an internal space of the cylindrical hollow portion 24 into a refrigerant inflow chamber 30 and a gas-liquid separation chamber 31. As shown in FIG. 5, a first communicating hole 33 extends through a common wall portion 32 of the tank plate 16 and the hollow portion 24 at a position above the partition wall 29 so that the refrigerant inflow chamber 30 communicates with the upper flow chamber 21 of the header tank 3 via the first communicating hole 33.

Figure 7:
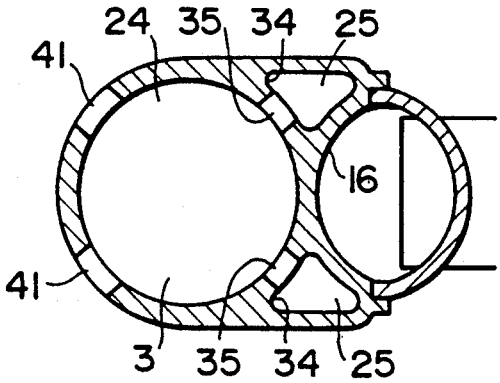
FIG. 7 is an enlarged cross-sectional view taken along line C—C of FIG. 1.
Figure 8:
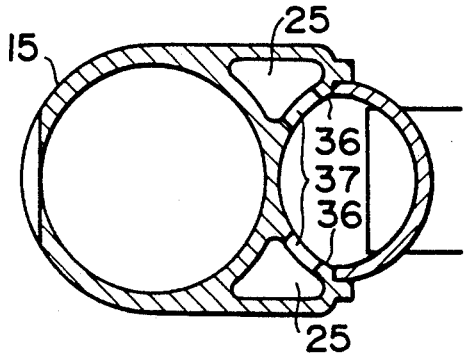
FIG. 8 is an enlarged cross-sectional view taken along line G—G of FIG. 1.

As shown in FIG. 7, a wall 34 of the extruded section member 15 that is common to each communicating passage 25 and the gas-liquid separation chamber 31 has second communicating holes 35 at a portion disposed slightly below the partition wall 29. The second communicating holes 35 communicate the communicating passages 25 with the gas-liquid separation chamber 31. In addition, a lower end portion of the extruded section member 15 has a pair of third communicating holes 37 extending through a pair of wall portions 36, respectively, which are common to the respective communicating passages 25 and the lower flow chamber 23. Thus, the communicating passages 25 communicate with the lower flow chamber 23 via the third communicating holes 37.

The second and third communicating holes 35 and 37 as well as the first communicating hole 33, are formed by punching. So far as the second communicating holes 35 are concerned, the punching operation is performed through working holes 41 shown in FIG. 7. The working holes 41 are closed fluid tight after the punching operation is finished.

Figure 9:
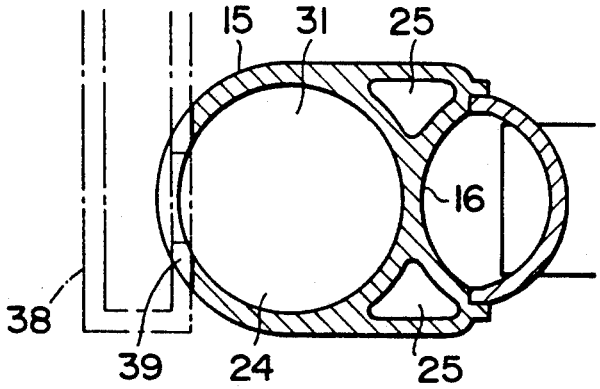
FIG. 9 is an enlarged cross-sectional view taken along line F—F of FIG. 1.

The cylindrical hollow portion 24 has a connecting hole 39 near the lower end thereof, as also shown in FIG. 9. The connecting hole 39 is communicating with a refrigerant outlet pipe 38.

Though not shown, a desiccant and a filter are received within the cylindrical hollow portion 24 at a portion disposed below the second communicating holes 35. It is preferable that the desiccant and the filter are able to maintain their performance characteristics without deterioration even when subjected to a high temperature during a brazing process. More specifically, the desiccant is preferably made of permutite, and the filter is preferably made of metal or ceramic.

Figure 10:
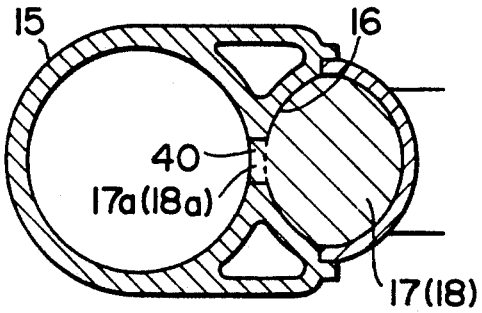
FIG. 10 is an enlarged cross-sectional view taken along line D—D or E—E of FIG. 1.

Each of the partition plates 17 and 18 of the header tank 3 has a projection 17*a* and 18*a* receivable in a hole 40 in the tank plate 16, as shown in FIG. 10, for positioning the partition plates 17 and 18 relative to the header tank 3 when they are brazed together.

The condenser 1 of the foregoing construction is manufactured as follows. The tube-receiving plates 7 and 14 are disposed in back to back confrontation with a proper spacing therebetween, and the tubes 4 are inserted into the tube-receiving holes 6 and 42 in the respective tube-receiving plates 7 and 14. In this instance, the fins 4 are disposed between the adjacent tubes 4. Then, after the partition plate 9 is placed on the tube-receiving plate 7, the tank plate 8 is fitted with the tube-receiving plate 7, and after that the end caps 10 and 11 are attached to opposite ends of a header tank 2 formed by the tube-receiving plate 7 and the tank plate 8. The tank plate 16 is fitted with the tube-receiving plate 14 with the partition plates 17 and 18 disposed therebetween, and subsequently the end caps 19 and 20 are attached to opposite ends of the header tank 3 formed by the tube-receiving plate 14 and the tank plate 16. Then the refrigerant inlet pipe 26 and the refrigerant outlet pipe 38 are fitted in the connecting holes 27 and 39, respectively. Thus, a condenser is preassembled. While keeping this preassembled condition, the condenser is brazed in a furnace.

With this construction, a refrigerant supplied from a compressor (not shown) flows from the refrigerant inlet pipe 26 into the refrigerant inflow chamber 30 and thence to the flow chamber 21 of the header tank 3 via the first communication hole 33. The refrigerant introduced into the flow chamber 21 then advances through a group of tubes 4 connected to the flow chamber 21 and enters the upper flow chamber 12 in the header tank 2, where the refrigerant moves downward. Subsequently, the refrigerant advances through a group of tubes 4 into the intermediate flow chamber 22 in the header tank 3. Thereafter, the refrigerant moves downward and flows through a group of tubes 4 into the lower flow chamber 13 in the header tank 2 where the refrigerant moves downward and then flows through a group of tubes 4 into the lower flow chamber 23 in the header tank 3.

Figure 11:
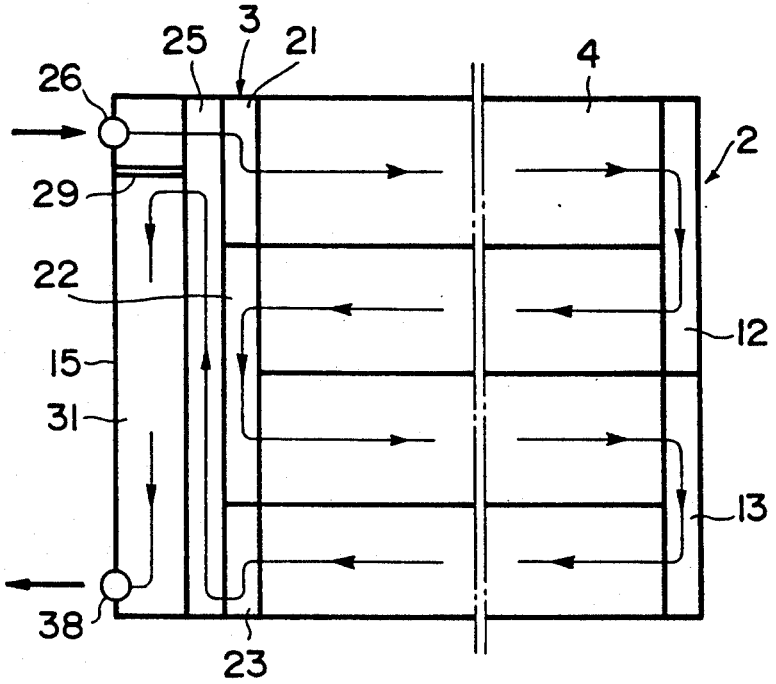
FIG. 11 is a diagrammatical view showing the flow path of a refrigerant in the condenser shown in FIG. 1.

The refrigerant introduced into the flow chamber 23 at the final stage subsequently flows from the third communication holes 37 into the communicating passages 25*a* and 25*b*, then is guided upward along the communicating passages 25*a* and 25*b*, and flows from the second communicating passages 35 into the gas-liquid separation chamber 31. Thereafter, the refrigerant passes through the desiccant and the filter and reaches the lower end of the gas-liquid separation chamber 31, from which it is fed successively through the connecting hole 39 and the refrigerant outlet pipe 38 into a non-illustrated expansion valve (see FIG. 11).

With the provision of the communicating passages 25, it is possible to guide the refrigerant to an upper part of the gas-liquid separation chamber 31 even when the refrigerant is fed from an upper position to a lower position while passing through a plurality of flow paths. Thus, a condenser having a plurality of flow paths can be used. Furthermore, the tube-receiving plates 7 and 14 are separated from the body of the receiver tank so that the tube-receiving holes 6 and 42 can be formed by punching with the utmost ease.

Figure 12:
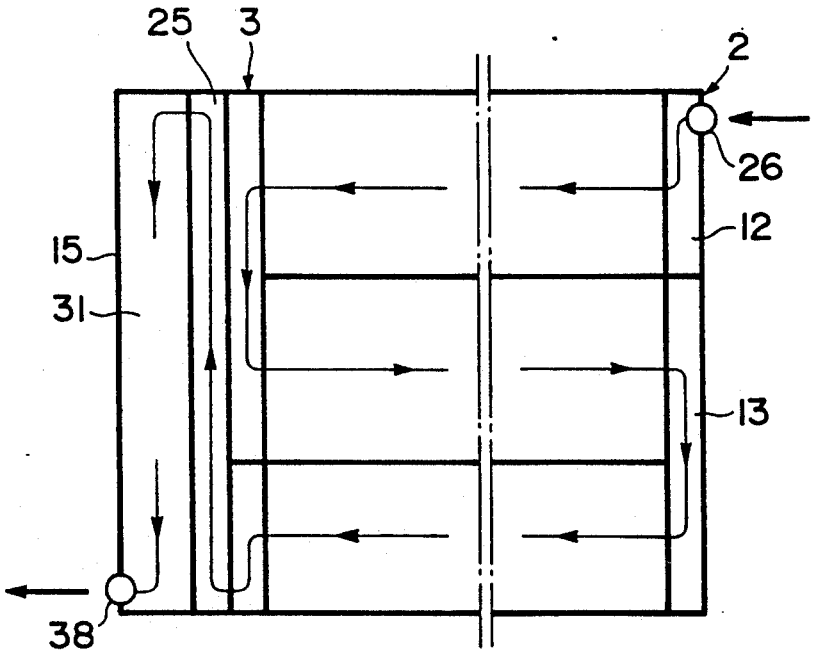
FIG. 12 is a diagrammatical view showing the flow path of a refrigerant in a modified condenser.

According to the foregoing construction, the refrigerant flows through even flow paths (four flow paths). In the case where the refrigerant flows through odd flow paths (three flow paths, for example), it is no longer necessary to provide the extruded section member 15 with the inflow chamber, as diagrammatically shown in FIG. 12. The refrigerant inlet pipe 26 is connected to the upper flow chamber 12 of the header tank 2.

In the embodiments described above, the refrigerant inlet pipe 26 is disposed at a higher position while the refrigerant outlet pipe 38 is disposed at a lower position. This positional relationship may be reversed, as diagrammatically shown in FIGS. 13 and 14.

Figure 13:
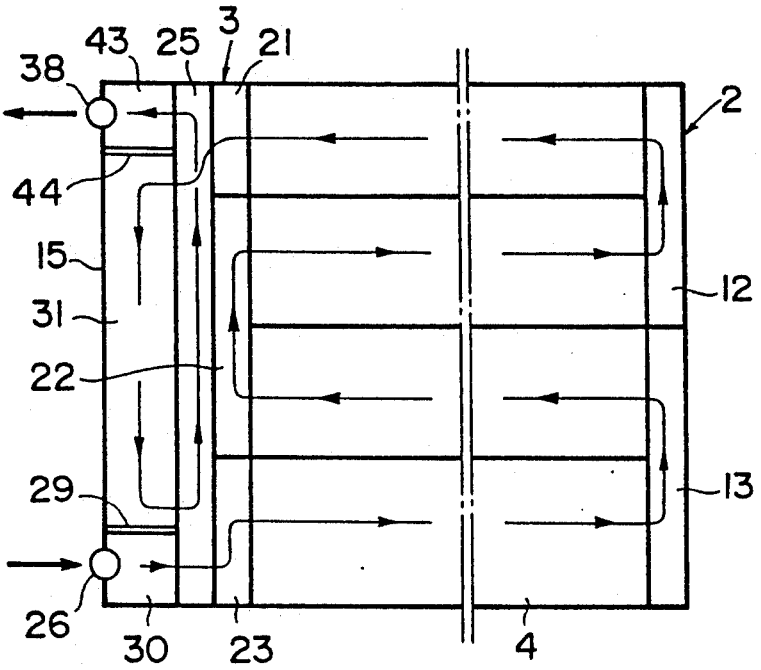
FIG. 13 is a view similar to FIG. 11 but showing the flow path of a modified condenser having an inlet and an outlet that are arranged in opposite relation to those of the condenser shown in FIG. 11.

FIG. 13 shows an embodiment in which the refrigerant flows through even flow paths (four flow paths). A lower end portion of the hollow portion 24 of the extruded member 15 has an inflow chamber 30 defined by a partition wall 29. The inflow chamber 30 communicates with a refrigerant inlet pipe 26 and a lower flow chamber 23. An upper end portion of the hollow member 24 has an outflow chamber 43 defined by a partition wall 44. The outflow chamber 43 communicates with a refrigerant outlet pipe 38 and the auxiliary passages 25*a* and 25*b*. An upper flow chamber 21 communicates with an upper portion of a gas-liquid separation chamber 31 that is defined between the inflow chamber 30 of the hollow portion and the outflow chamber 43. A lower portion of the gas-liquid separation chamber 31 communicates with the communicating passages 25*a* and 25*b*. Other parts are the same as those parts shown in the foregoing embodiments and, hence, a further description of these parts will be omitted.

With this arrangement, the refrigerant supplied from the refrigerant inlet pipe 26 into the inflow chamber 26 flows from the lower flow chamber 23 through the tubes 4 to the lower flow chamber 13 in the header tank 2, in which the refrigerant moves upward. Subsequently, the refrigerant advances through the tubes 4 to the intermediate flow chamber 22 in the header tank 3, and after that the refrigerant moves upward and then flows through the tubes 4 into the upper flow chamber 12 in the header tank 2. Within the upper flow chamber 12, the refrigerant moves upward and then advances through the tubes 4 to the upper flow chamber 21 in the header tank 3.

The refrigerant that is fed into the final flow chamber 21 moves into the gas-liquid separation chamber 31, in which it flows down through the desiccant and the filter. Then the refrigerant moves into the communicating passages 25, is guided upwardly, and finally is fed through the outflow chamber 43 to the refrigerant outlet pipe 38.

Figure 14:
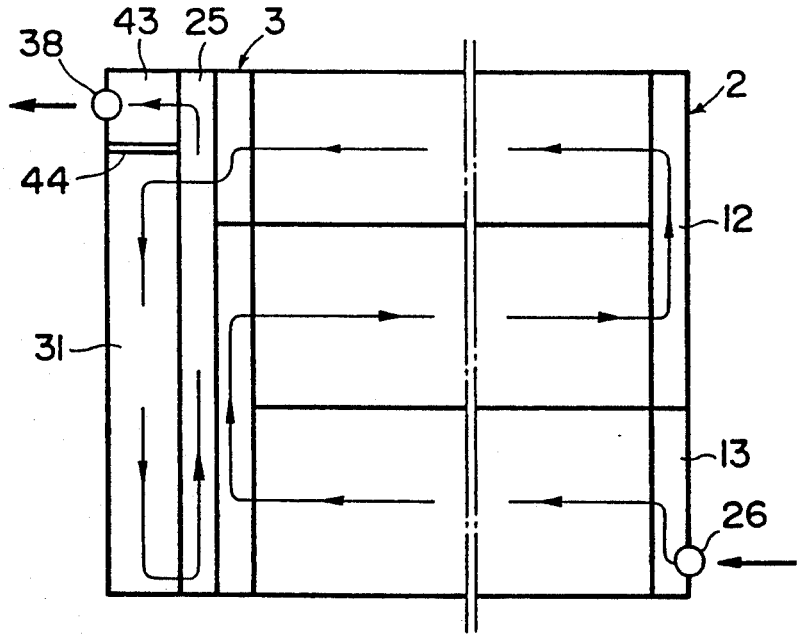
FIG. 14 is a view similar to FIG. 12 but showing the flow path of another modified condenser having an inlet and an outlet that are arranged in opposite relation to those of the condenser shown in FIG. 12.

In the case where the refrigerant flows through an odd number of flow paths, the inflow chamber 30 may be omitted, as shown in FIG. 14. The refrigerant inlet pipe 26 is connected to the lower flow chamber 13 in the header tank 2. In this instance, the refrigerant outlet pipe 38 may be connected directly to the communicating passages 25 without the agency of the outflow chamber 43.

Figure 15:
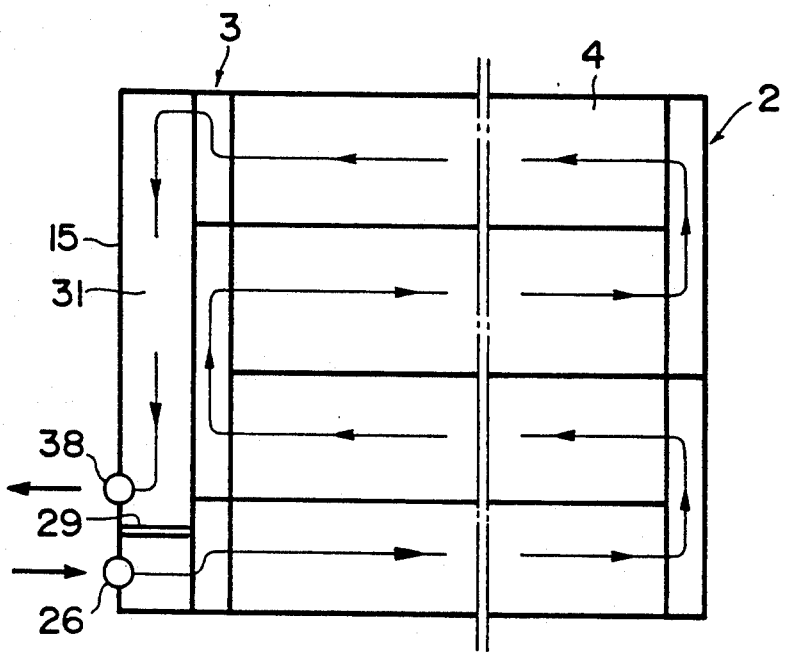
FIG. 15 is a diagrammatical view showing the flow path of a refrigerant in a condenser of the type which is devoid of auxiliary passages.
Figure 16:
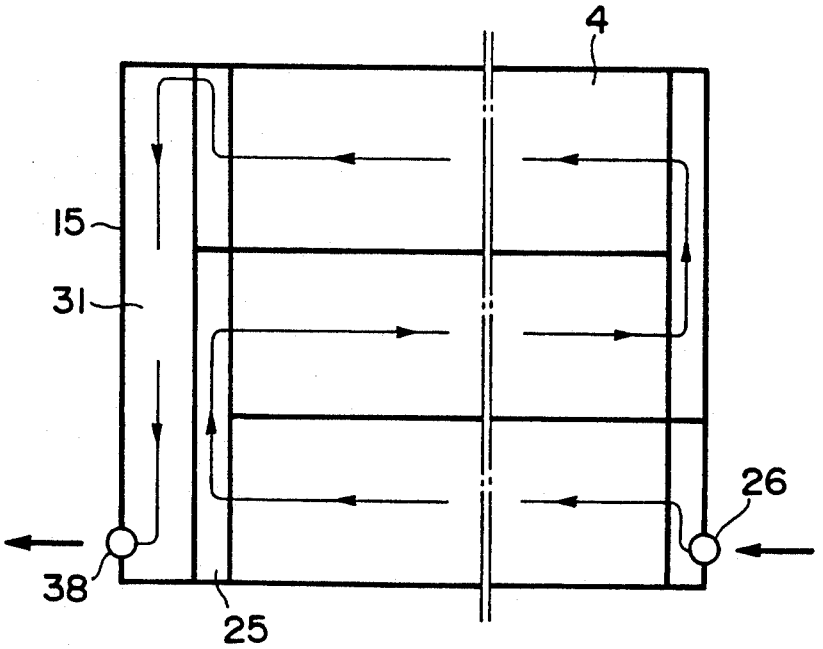
FIG. 16 is a diagrammatical view showing the flow path of a refrigerant in a modified condenser.
Figure 17:
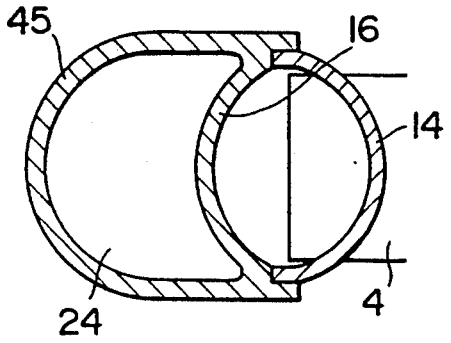
FIGS. 17 through 20 are cross-sectional views showing various modifications of an extruded section member devoid of auxiliary passages.
Figure 18:
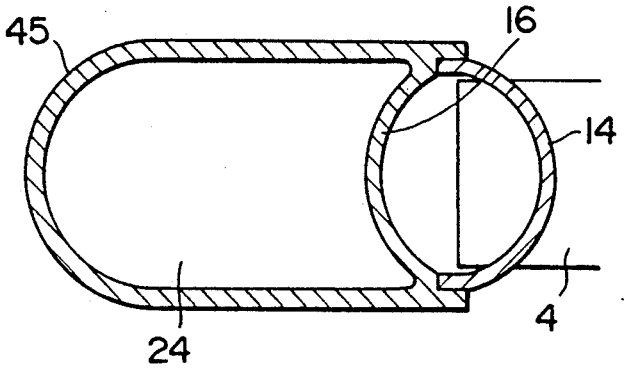
Figure 19:
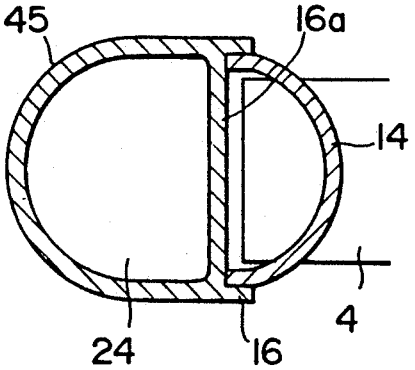
Figure 20:
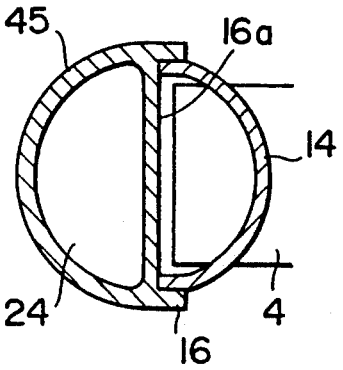

The refrigerant outlet pipe 38 shown in FIGS. 13 and 14 may be connected to a lower end portion of the, gas-liquid separation chamber 31 without using the communicating passages 25. In this instance, the auxiliary passages are no longer needed, as shown in FIGS. 15 and 16, so that a further structural simplification can be attained while keeping the same functional effects as the embodiments shown in FIGS. 13 and Examples of an extruded section member 45 devoid of auxiliary passages are shown in FIGS. 17 through 20. These extruded section members 45 are the same as the extruded section member having auxiliary passages in that they have an integral tank plate 16. The extruded section member 45 shown in FIG. 17 is structurally the same as the extruded section member shown in FIG. 3, except that a wall that is common to the hollow portion 24 and each communicating passage 25 is removed. The extruded section member 45 shown in FIG. 18 has a hollow portion 24 expanded in the longitudinal direction of the condenser for purposes of application to a large capacity condenser. The extruded section member 45 shown in FIG. 19 includes a tank plate 16 of a U shape instead of an arcuate shape, the U-shaped tank plate 16 having a flat wall 16*a* separating a flow chamber and a gas-liquid separation chamber. The extruded section member 45 shown in FIG. 20 differs from the extruded section member 45 shown in FIG. 19 in that the hollow portion 24 has a relatively short extent in the longitudinal direction of the condenser for purposes of application to a small capacity condenser.

The capacity of the receiver tank can be adjusted by changing the cross-sectional shape of the gas-liquid separation chamber, adjusting the length of the extruded section member, or adjusting the effective space in the gas-liquid separation chamber by a partition disposed therein.

As described above, according to the invention, the header tanks and the tubes are connected via the tube-receiving plates that are separated from the body of a receiver tank so that formation of the tube-receiving holes and application of cladding materials can easily be performed. Since the upper end portion of the gas-liquid separation chamber formed in the extruded section member communicates with the flow chamber at the final stage, the condenser may have a plurality of flow paths for the passage therethrough of a refrigerant.

Figure 21:
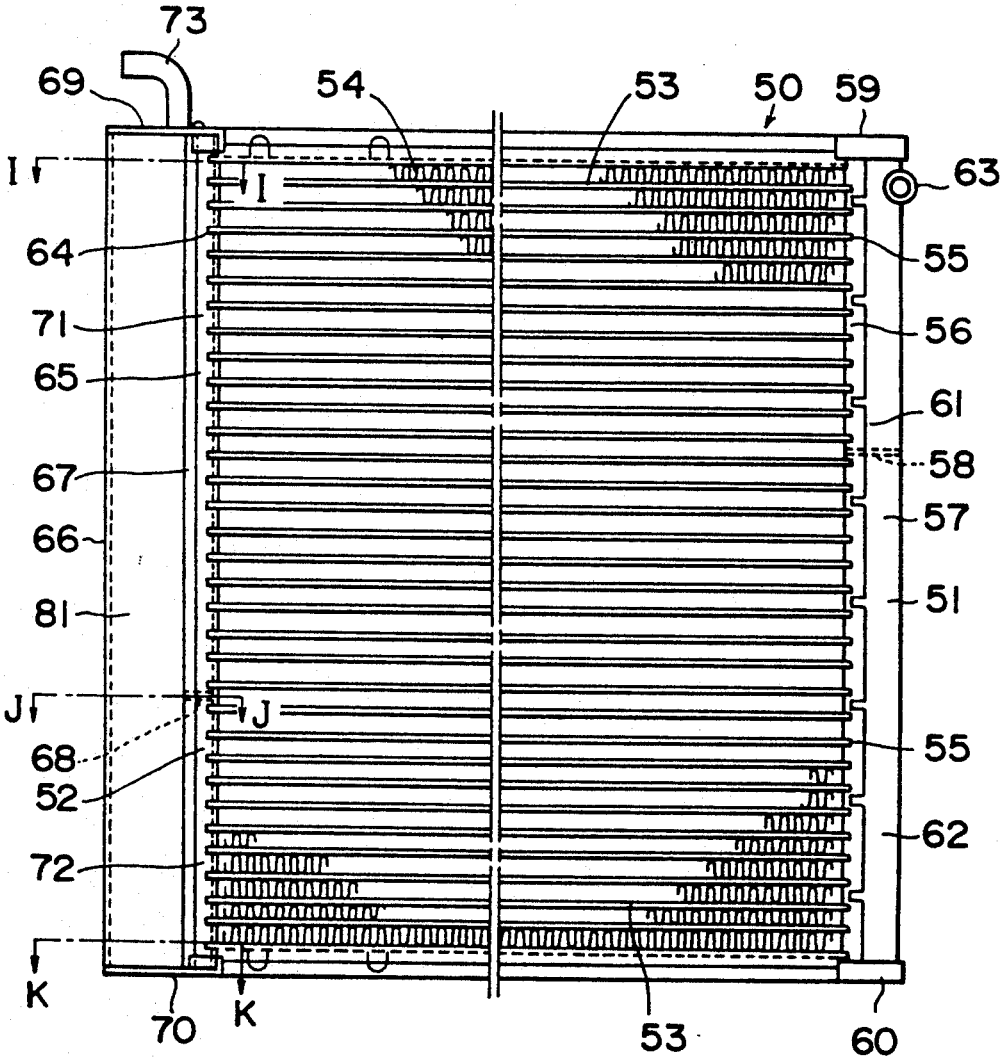
FIG. 21 is a front elevational view of a condenser having a receiver tank formed integrally therewith according to another embodiment of this invention.

FIG. 21 shows a condenser 50 with a receiver tank formed integrally therewith, which is so constructed as to thermally separate a hollow portion 74 defining the receiver tank and refrigerant flowing through a flow chambers 71 and 72 defined in a header tank 52.

Figure 22:
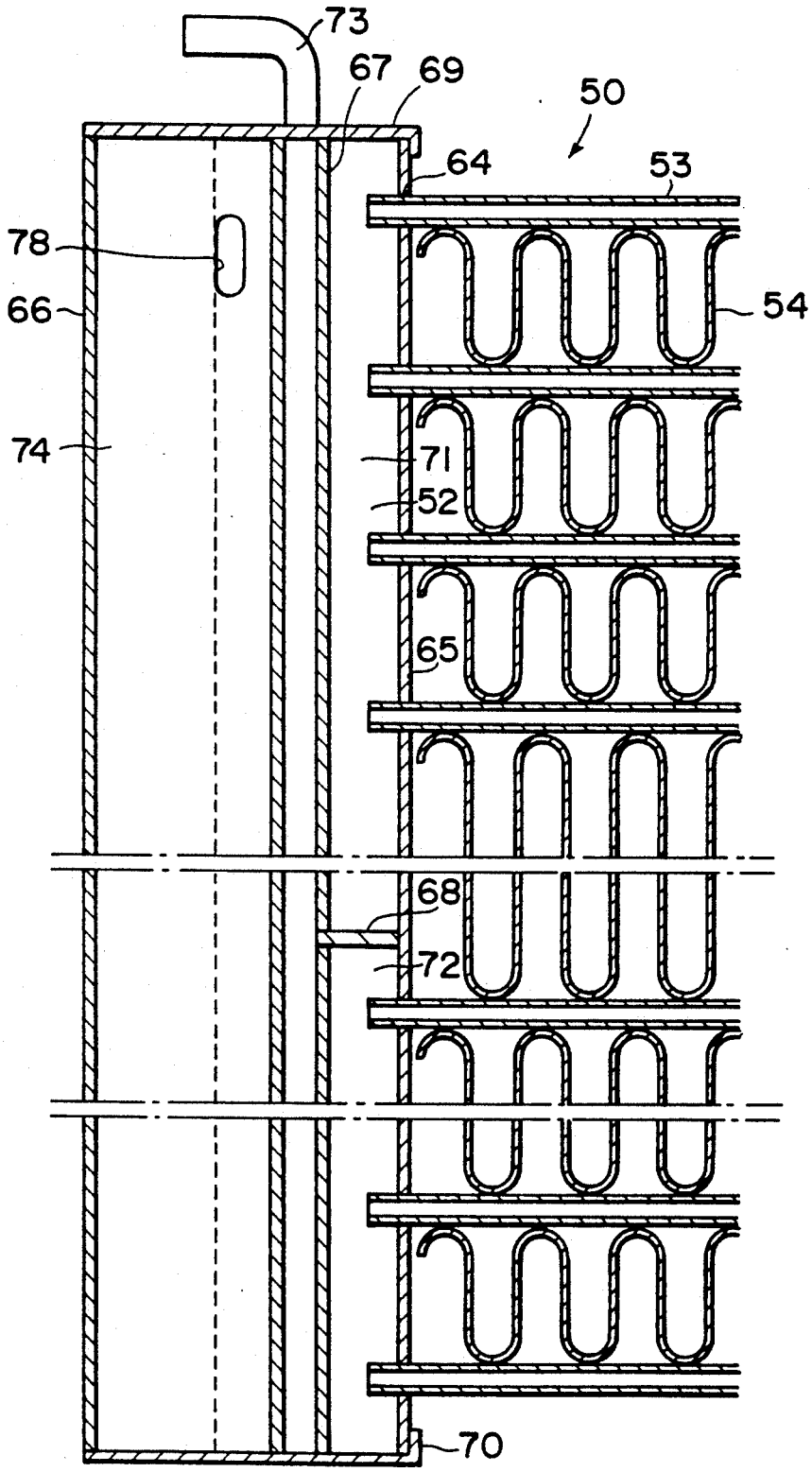
FIG. 22 is an enlarged cross-sectional view of a portion of one of a pair of header tanks of the condenser shown in FIG. 21.

The condenser 50 shown in FIGS. 21 and 22 includes a header tank 51 having upper and lower flow chambers 61 and 62 separated by a partition plate 58, while the header tank 52 has upper and lower flow chambers 71 and 72 separated by a partition plate 68. Thus, a refrigerant flow passage having three paths is formed.

The condenser 50 includes the pair of opposed header tanks 51 and 52, a plurality of parallel spaced tubes 53 interconnecting the two header tanks 51 and 52, and a plurality of fins 54 each disposed between two adjacent ones of the tubes 53.

The header tank 51 is composed of an arcuate tube-receiving plate 56 with a row of tube-receiving holes 55 along the length thereof and an arcuate tank plate 57 joined with the tube-receiving plate 56 in face to face confrontation, with the partition plate 58 disposed between the tube-receiving plate 56 and the tank plate 57 so as to define the upper and lower flow chambers 61 and 62 on opposite sides of the partition plate 58. Upper and lower ends of the header tank 51 are closed by upper and lower end caps 59 and 60, respectively. The header tank 51 has at its upper end a refrigerant inlet pipe 63 from which a refrigerant flows into the header tank 51.

On the other hand, the header tank 52 is composed of an arcuate tube-receiving plate 65 with a row of tube-receiving holes 64 along the length thereof and an arcuate tank plate 67 formed integrally with an extruded section member 66 (described later) and joined with the tube-receiving plate 65 in face to face confrontation, with a partition plate 68 disposed between the tube-receiving plate 65 and the tank plate 67 so as to define therebetween the upper and lower flow chambers 71 and 72 on opposite sides of the partition plate 68. Upper and lower ends of the header tank 52 are closed by upper and lower end caps 69 and 70, respectively. The end caps 69 and 70 also close upper and lower ends of the extruded section member 66. The upper end cap 69 is provided with a refrigerant outlet pipe 73.

Figure 23A:
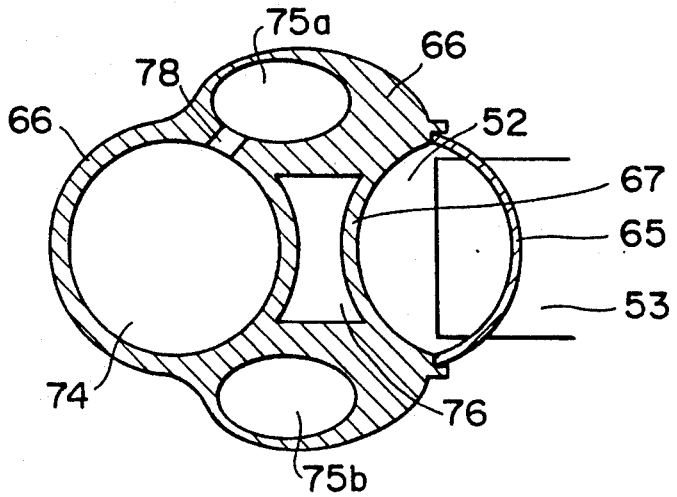
FIG. 23(*a*) is an enlarged cross-sectional view taken along line I—I of FIG. 21.
Figure 23B:
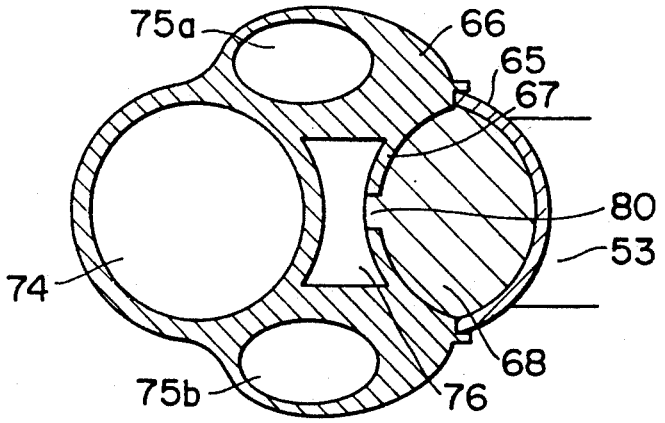
Figure 23C:
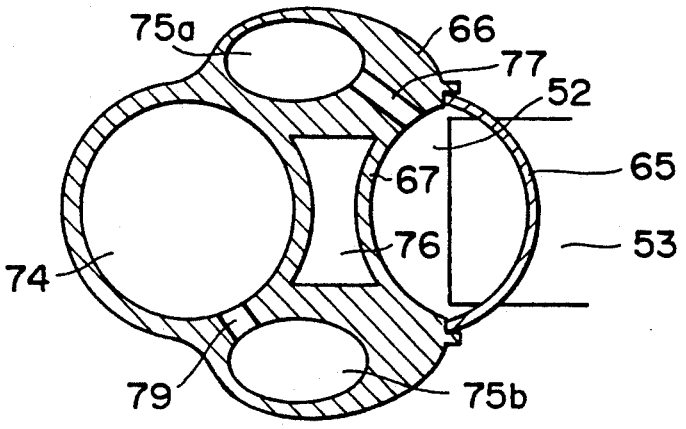

The extruded section member 66, as shown in FIGS. 23(*a*), 23(*b*) and 23(*c*), taken along line I—I, line J—J and line K—K, respectively, of FIG. 21, includes a substantially cylindrical hollow portion 74 and has a pair of laterally spaced communicating passages 75*a* and 75*b* provided outside the cylindrical hollow portion 74 along the length thereof and a heat insulating space 76 provided between the hollow portion 74 and the tank plate 67. As shown in FIG. 23 (*c*), the communicating passage 75*a* communicates through a communicating passage 77 with the lower flow chamber 72 at a lower portion of the extruded section member 66. The communicating passage 75*a* also communicates with the hollow portion 74 through a communicating passage 78 at an upper portion of the header tank 52, as shown in FIG. 23(*a*).

As shown in FIG. 23(*c*), the communicating passage 75*a* communicates through a communicating passage 79 with the hollow portion 74 at the lower portion of the extruded section member 66, and also communicates with the refrigerant outlet pipe 73 formed on the end cap 69 closing the upper end of the header tank 52. In FIG. 23(*b*), numeral 80 is a hole in which a projection of the partition plate 68 is inserted for positioning the partition plate 68 in preparation for brazing of the condenser.

Figure 24:
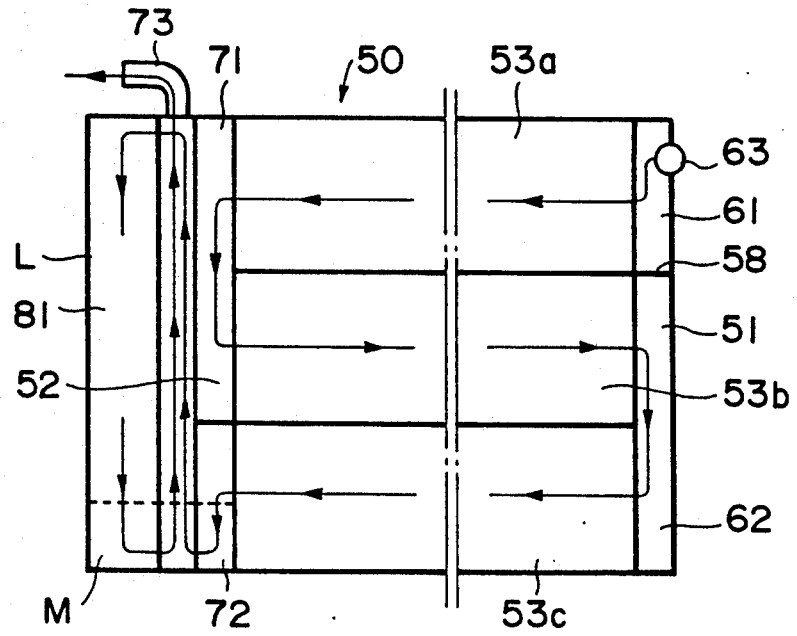
FIG. 24 is a diagrammatical view showing the flow path of a refrigerant in the condenser shown in FIG. 21.

With the condenser 50 thus constructed, a hot gaseous refrigerant that is fed under pressure from a compressor (not shown) constituting a part of a refrigeration cycle is supplied from the refrigerant inlet pipe 63 into the upper flow chamber 61 in the header tank 51. As shown in FIG. 24, the hot and compressed gaseous refrigerant flows through an upper group of tubes 53*a* into the upper flow chamber 71 in the header tank 52 in which it takes a U-turn and then advances through an intermediate group of tubes 53*b*. The refrigerant takes a U-turn again in the lower flow chamber 62 in the header tank 51 and then flows through a lower group of tubes 53*c* into the lower flow chamber 72 in the header tank 52. The hot and compressed gaseous refrigerant, as it flows through the upper, intermediate and lower groups of tubes 53*a*, 53*b* and 53*c*, gives off heat to air flowing around the fins 54 disposed between the adjacent tubes 53, with the result that the hot and compressed gaseous refrigerant is changed in phase into a hot and compressed liquid refrigerant. The ratio of the liquid refrigerant to the gaseous refrigerant progressively increases in a direction from the upstream side to the downstream side of the flow passage.

The refrigerant, as it arrives at the final flow chamber 72, contains a slight amount of the gaseous component. The refrigerant then flows from the communicating passage 77 into the communicating passage 75*a*, subsequently moves upward along the auxiliary passage 75*a*, and finally falls from the communicating passage 78 into a receiver tank 81 provided within the hollow portion 74.

The refrigerant is subjected a gas-liquid separation process within the receiver tank 81 and after that, the de-watered liquid refrigerant moves from the lower end portion of the hollow portion 74 into the communicating passage 75*b* via the communicating passage 79, then flows upward along the communicating passage 75*b*, and finally is fed from the refrigerant outlet pipe 73 toward an expansion valve (not shown) of the refrigeration cycle.

In the condenser 50 with three paths, the refrigerant, as it flows through the upper flow chamber 71, contains a large amount of the hot and compressed gaseous component. The refrigerant, therefore, has a temperature considerably higher than the temperature of the refrigerant flowing through communicating passages 75*a* and 75*b* located adjacent to the upper flow chamber 71 and through the receiver tank 81. However, due to the presence of, the heat insulating space 76 provided between the communicating passages 75*a* and 75*b*, the receiver tank 81 and the header tank 52, the communicating passages 75*a* and 75*b*, the receiver tank 81 and the header tank 52 are thermally separated or isolated from one another. The refrigerant is, therefore, prevented from vaporizing again within the communicating passages 75*a* and 75*b*; and the receiver tank 81 under the influence of heat.

Figure 25A:
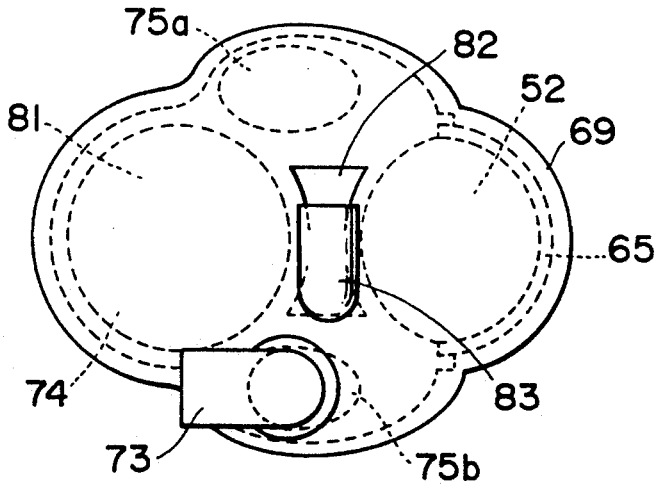
FIG. 25(*a*) is a plan view of an end cap having a discharge hole and an opening.
Figure 25B:
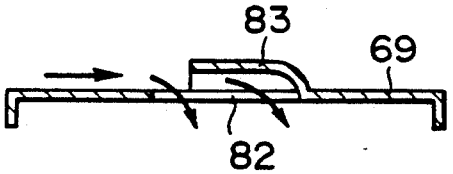

As shown in FIG. 25, the heat insulating space 76 communicates with an opening 82 formed in the end cap 69. The end cap 69 is provided with a baffle plate 83, disposed adjacent to the opening 82 and opening toward an upstream direction of wind for positively guiding air into the heat insulating space 76, thereby increasing the efficiency of cooling of the extruded section member 66.

Figure 26:
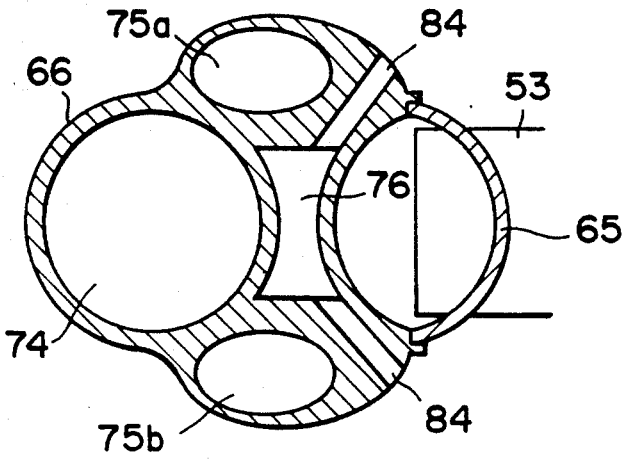
FIG. 26 is a cross-sectional view showing an exhaust passage in a heat insulating space.

The air introduced into the heat insulating space 76 from an upper end thereof is discharged therefrom to the outside of the extruded section member 66 via a communicating passage 84 that is properly formed at an intermediate portion of the extruded section member 66, as shown in FIG. 26.

Figure 27A:
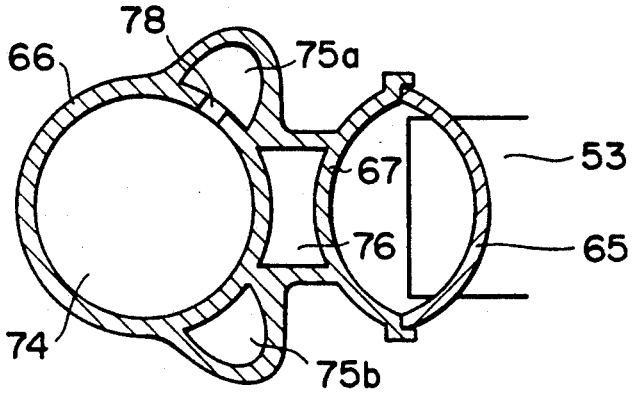
FIG. 27(*a*) is an enlarged cross-sectional view of a portion of the extruded section member indicated by L in FIG. 24.
Figure 27B:
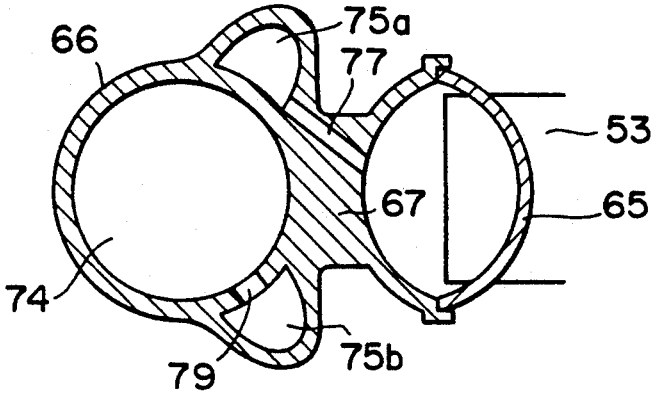

FIGS. 27(*a*) and 27(*b*) show a modified form of the extruded section member of the three path condenser 50 described above. FIG. 27(*a*) is a cross-sectional view of a portion of the modified extruded section member that corresponds to the portion indicated by L in FIG. 24, and FIG. 27(*b*) is a cross-sectional view of a portion of the modified extruded section member that corresponds to the portion indicated by M in FIG. 24. The portion shown in FIG. 27(*a*) has the same cross-sectional shape as the portion shown in FIG. 27(*b*), however the position shown in FIG. 27(*b*) does not have a heat insulating space 76. This is because the temperature of the refrigerant flowing through the flow chamber 72 is equal to the temperature of the refrigerant flowing through a lower portion of the receiver tank 81, and hence heat has no effect on the vaporization of the refrigerant.

Figure 28A:
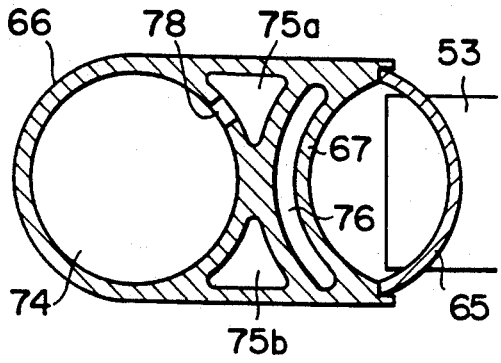
FIG. 28(*a*) is a view similar to FIG. 27(*a*), but showing a modified form of the portion L of the extruded section member.
Figure 28B:
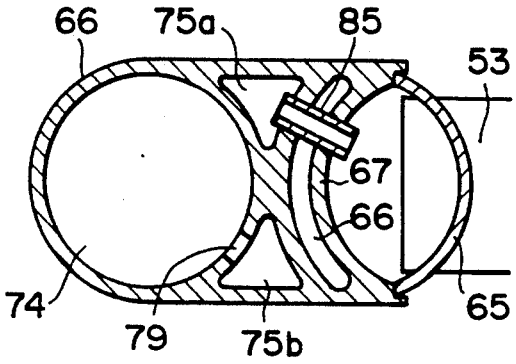

FIGS. 28(*a*) and 28(*b*) show another modified form of the extruded section member of the three path condenser 50 described above. FIG. 28(*a*) is a cross-sectional view of a portion of the modified extruded section member that corresponds to the portion indicated by L in FIG. 24, while FIG. 28(*b*) is a cross-sectional view of a portion of the modified extruded section member that corresponds to the portion indicated by M in FIG. 24. This embodiment is characterized in that the communicating passage 77 extending across the heat insulating space 76 is defined by a tube 85, as shown in FIG. 28(*b*). The extruded section member 66 thus constructed has a simple configuration and hence can be manufactured easily.

Figure 29:
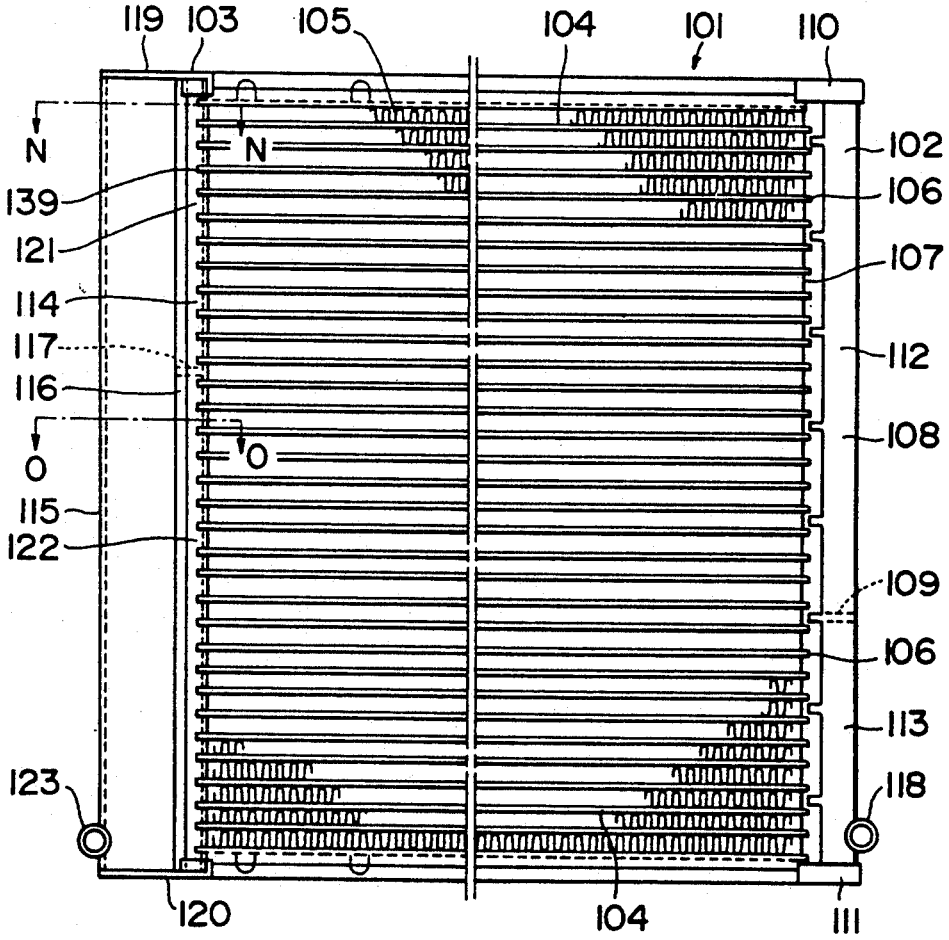
FIG. 29 is a front elevational view of a condenser having a receiver tank formed integrally therewith according to another embodiment of this invention.

FIG. 29 shows a condenser 101 with a receiver tank formed integrally therewith. The condenser 101 includes a pair of opposed header tanks 102 and 103, a plurality of parallel spaced tubes 104 interconnecting the two header tanks 102 and 103, and a plurality of fins 105 each disposed between two adjacent ones of the tubes 104.

The header tank 102 is composed of an arcuate tube-receiving plate 107 with a row of tube-receiving holes 106 along the length thereof, and an arcuate tank plate 108 joined with the tube-receiving plate 107 in face to face confrontation. A partition plate 109 is disposed between the tube-receiving plate 107 and the tank plate 108 so as to define upper and lower flow chambers 112 and 113 on opposite sides of the partition plate 109. Upper and lower ends of the header tank 102 are closed by upper and lower end caps 110 and 111, respectively. A refrigerant inlet pipe 118 is provided on a lower end portion of the header tank 102 for introducing a refrigerant into the header tank 102.

On the other hand, the header tank 103 is composed of an arcuate tube-receiving plate 114 with a row of tube-receiving holes 139 along the length thereof, and an arcuate tank plate 116 formed integrally with an extruded section member 115 (described later) and joined with the tube-receiving plate 114 in face to face confrontation. A partition plate 117 is disposed between the tube-receiving plate 114 and the tank plate 116 so as to define therebetween upper and lower flow chambers 121 and 122 on opposite sides of the partition plate 117. Upper and lower ends of the header tank 103 are closed by upper and lower end caps 119 and 120, respectively. A refrigerant outlet pipe 123 is provided on a lower end portion of the extruded section member 115.

Figure 30A:
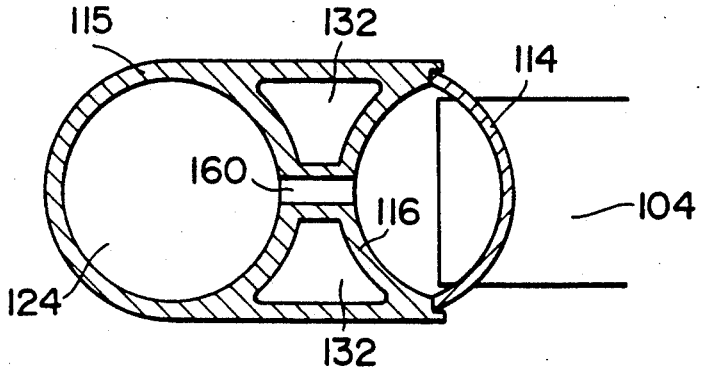
FIG. 30(*a*) is an enlarged cross-sectional view of an extruded section member taken along line N—N of FIG. 29.
Figure 30B:
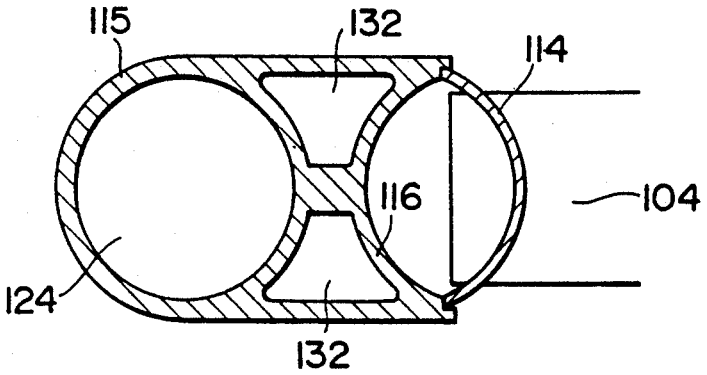

The extruded section member 115 of the condenser 101 has, as shown in FIG. 30(*a*) (which is a cross-sectional view taken along line N—N of FIG. 29), a communicating passage 160 interconnecting an upper portion of the header tank 103 and a hollow portion 24. An intermediate portion of the extruded section member 115 has a pair of heat insulating spaces 132 provided between the cylindrical hollow portion 124 and the tank plate 116, as shown in FIG. 30(*b*) (a cross-sectional view taken along line 0—0 of FIG. 29).

With the condenser 101 of the foregoing construction, a hot and compressed gaseous refrigerant is supplied from the refrigerant inlet pipe 118 into the condenser 101. Then the refrigerant flows from the lower flow chamber 113 in the header tank 102 through a lower group of tubes 104*c* into the lower flow chamber 122 in the header tank 103, where it takes a U-turn. After that the refrigerant advances through an intermediate group of tubes 104*b* to the upper flow chamber 112 in the header tank 102. In the flow chamber 112, the refrigerant takes a U-turn again and then advances through an upper group of tubes 104*a* to the upper flow chamber 121 in the header tank 103. Subsequently, the refrigerant falls from the flow chamber 121 into a receiver tank 131 and then is discharged from the refrigerant outlet pipe 123 into an expansion valve, not shown.

Figure 31:
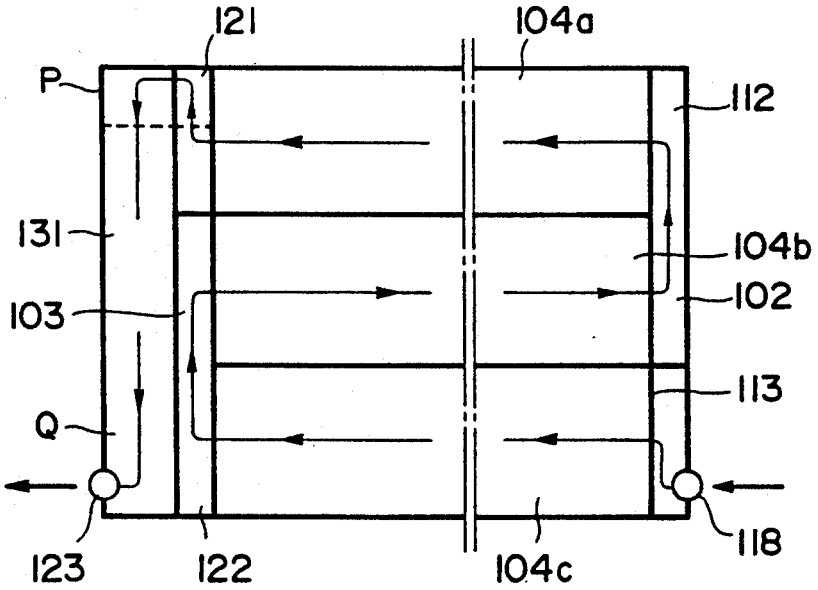
FIG. 31 is a diagrammatical view illustrative of the flow path of a refrigerant in the condenser shown in FIG. 29.
Figure 32A:
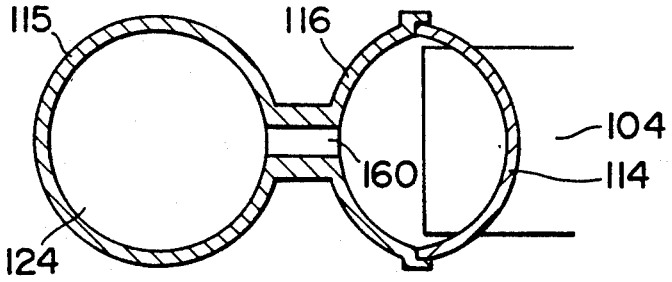
FIG. 32(*a*) is an enlarged cross-sectional view of a portion of the condenser indicated by P in FIG. 31, showing a modified extruded section member.
Figure 32B:
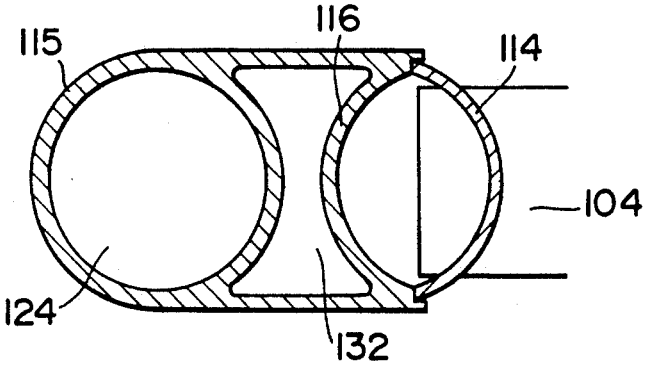

Two portions of the extruded member 115 that are indicated by P and Q, respectively, in FIG. 31 are shown in FIGS. 32(*a*) and 32(*b*). FIG. 32(*a*) is a cross-sectional view of the portion P and FIG. 32(*b*) is a cross-sectional view of the portion Q. In this embodiment, the heat insulating space 132 communicates with the outside of the extruded section member 115 at a junction between the portion P shown in FIG. 32(*a*) and the portion Q shown in FIG. 32(*b*), so that the heat insulating space 132 can be ventilated. With the condenser 101 thus constructed, the temperature of the refrigerant flowing through the flow chamber 122 is high so that, as opposed to the condenser 50 shown in FIG. 21, the heat insulation of the lower portion of the extruded section member can be performed effectively.

Figure 33A:
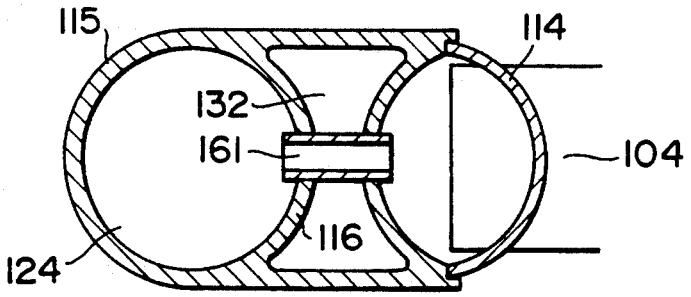
FIG. 33(*a*) is a view similar to FIG. 32(*a*), but showing another modified extruded section member.
Figure 33B:
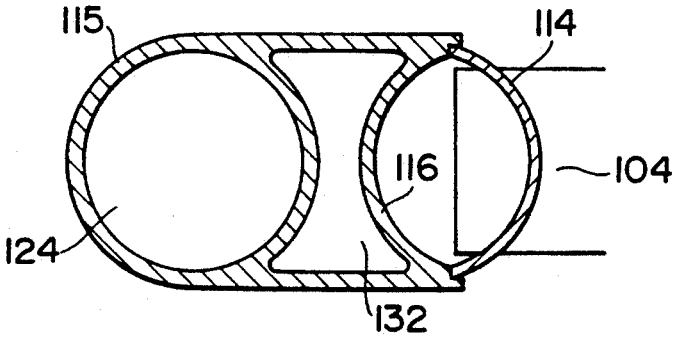

FIG. 33 shows a modified form of the extruded section member 115 of the condenser 101. The extruded section member 115 includes a tube 161 extending across the heat insulating space 132 so as to define therein a communicating passage extending through the cylindrical hollow portion 124 and an upper portion of the header tank 103. The extruded section member 115 thus constructed has a simple configuration and hence can be manufactured easily.

As described above, according to the invention, a heat insulating space is provided between a header tank in which a hot refrigerant flows, and a receiver tank in which a cold refrigerant flows, thereby blocking transfer of heat between the header tank and the receiver tank. Even in the case of a condenser of the type having a receiver tank formed integrally with the condenser, a refrigerant flowing within the receiver tank is not affected very much by the hot refrigerant flowing within the header tank.

Obviously, various modifications and variations of the present invention are possible in the light of the above teaching. It is therefore to be understood that within the scope of the appended claims the present invention may be practiced otherwise than as specifically described.

What is claimed is:

1. A condenser, comprising:

a pair of opposed header tanks;

a plurality of tubes interconnecting said pair of opposed header tanks;

a plurality of fins, each of said fins being disposed between two adjacent ones of said tubes;

a receiver tank integrally formed with one of said pair of header tanks; and a plurality of internal flow chambers defined in each of said header tanks, said internal flow chambers extending in a longitudinal direction of said header tanks, and said plurality of internal flow chambers of both said header tanks including a first said internal chamber and a final said internal chamber defined in said header tanks such that a refrigerant supplied to said condenser through the first said internal chamber flows to the final said internal chamber through said tubes by making a plurality of U-turns, each said U-turn being formed by a said internal chamber in a said header and a plurality of said tubes connected therewith;

wherein said receiver tank has an upper portion communicating with the final said internal chamber through a communicating passage defined therebetween, said communicating passage extending in the longitudinal direction of said receiver tank.

2. The condenser of claim 1, wherein each said header tank comprises a tube-receiving plate to which said plurality of tubes are connected and a tank plate fitted with said tube receiving plate.

3. The condenser of claim 2, wherein said tank plate is integral with an extruded section member having a hollow portion defining a gas-liquid separation chamber of said receiver tank, said extruded section member further defining said communicating passage.

4. The condenser of claim 2, wherein said tube-receiving plates, said tank plates and said tubes have a cladding of brazing material.

5. The condenser of claim 1, wherein one of said header tanks has an inflow chamber integral therewith, said inflow chamber having a refrigerant inlet and communicating with the first said internal chamber.

6. A condenser, comprising:

a pair of opposed header tanks;

a plurality of tubes interconnecting said pair of opposed header tanks;

a plurality of fins, each of said fins being disposed between two adjacent ones of said tubes;

a receiver tank integrally formed with one of said pair of header tanks; and a plurality of internal flow chambers defined in each of said header tanks, said internal flow chambers extending in a longitudinal direction of said header tanks, and said plurality of internal flow chambers of both said header tanks including a first said internal chamber and a final said internal chamber defined in said header tanks such that a refrigerant supplied to said condenser through the first said internal chamber flows to the final said internal chamber through said tubes by making a plurality of U-turns, each said U-turn being formed by a said internal chamber in a said header and a plurality of said tubes connected therewith;

wherein said receiver tank has an upper portion communicating with the final said internal chamber through a communicating passage defined therebetween, the final said internal chamber being provided in an upper portion of one of said header tanks, and a refrigerant inlet being defined on one of said header tanks at a lower portion thereof.

7. The condenser of claim 6, wherein each said header tank comprises a tube-receiving plate to which said plurality of tubes are connected and a tank plate fitted with said tube receiving plate.

8. The condenser of claim 7, wherein said tank plate is integral with an extruded section member having a hollow portion defining a gas-liquid separation chamber of said receiver tank, said extruded section member further defining said communicating passage.

9. The condenser of claim 7, wherein said tube-receiving plates, said tank plates and said tubes have a cladding of brazing material.

10. The condenser of claim 6, wherein one of said header tanks has an inflow chamber integral therewith, said inflow chamber having said refrigerant inlet therein.

11. The condenser of claim 6, wherein one of said header tanks has:

an outflow chamber integral therewith; and another communicating passage defined between and communicating said outflow chamber and a lower portion of said receiver tank.

12. A condenser, comprising:

a pair of opposed header tanks;

a plurality of tubes interconnecting said pair of opposed header tanks;

a plurality of fins, each of said fins being disposed between two adjacent ones of said tubes;

a receiver tank integrally formed with one of said pair of header tanks; and a plurality of internal flow chambers defined in each of said header tanks, said internal flow chambers extending in a longitudinal direction of said header tanks, and said plurality of internal flow chambers of both said header tanks including a first said internal chamber and a final said internal chamber defined in said header tanks such that a refrigerant supplied to said condenser through the first said internal chamber flows to the final said internal chamber through said tubes by making a plurality of U-turns, each said U-turn being formed by a said internal chamber in a said header and a plurality of said tubes connected therewith;

wherein said receiver tank has an upper portion communicating with the final said internal chamber through a communicating passage defined therebetween; and wherein a heat insulating space is defined between said one of said pair of header tanks and said receiver tank, said heat insulating space extending longitudinally along said receiver tank.

13. The condenser of claim 12, wherein each said header tank comprises a tube-receiving plate to which said plurality of tubes are connected and a tank plate fitted with said tube receiving plate.

14. The condenser of claim 12, wherein said tank plate is integral with an extruded section member having a hollow portion defining a gas-liquid separation chamber of said receiver tank, said extruded section member further defining said communicating passage and said heat insulating space.

15. The condenser of claim 12, wherein said tube-receiving plates, said tank plates and said tubes have a cladding of brazing material.

16. The condenser of claim 12, wherein said heat insulating space communicates with outside air.

* * * * *